343-754 SR
5/21/85 OR 4,518,966

United States Patent [19]
Sadones

[11] Patent Number: 4,518,966
[45] Date of Patent: May 21, 1985

[54] ADAPTIVE SPATIAL MICROWAVE FILTER FOR MULTIPOLARIZED ANTENNAS AND THE PROCESS OF ITS APPLICATION

[75] Inventor: Henri Sadones, Paris, France

[73] Assignee: Societe d'Etude du Radant, Les Ulis Cedex, France

[21] Appl. No.: 426,379

[22] Filed: Sep. 29, 1982

[30] Foreign Application Priority Data

Oct. 5, 1981 [FR] France ..... 81 18674

[51] Int. Cl.³ ..... H01Q 17/00
[52] U.S. Cl. ..... 343/754; 343/909
[58] Field of Search ..... 343/753-756, 343/909, 379, 806

[56] References Cited

U.S. PATENT DOCUMENTS

| | | | |
|---|---|---|---|
| 3,276,023 | 9/1966 | Dorne et al. | 343/754 |
| 3,708,796 | 1/1973 | Bony | 343/754 |
| 3,769,623 | 10/1973 | Fletcher et al. | 343/909 |
| 3,896,440 | 7/1975 | Wheeler | 343/18 D |
| 3,955,201 | 5/1976 | Crump | 343/701 |
| 4,021,812 | 5/1977 | Schell et al. | 343/753 |
| 4,160,254 | 6/1979 | Wise | 343/909 |
| 4,212,014 | 7/1980 | Chekroun | 343/754 |
| 4,266,203 | 5/1981 | Saudreau et al. | 343/786 |
| 4,320,404 | 3/1982 | Chekroun | 343/754 |
| 4,344,077 | 8/1982 | Chekroun et al. | 343/754 |
| 4,447,815 | 5/1984 | Chekroun et al. | 343/754 |

FOREIGN PATENT DOCUMENTS

| | | | |
|---|---|---|---|
| 42612 | 12/1981 | European Pat. Off. | 343/756 |
| 2281659 | 3/1976 | France . | |
| 2382109 | 9/1978 | France . | |
| 2448231 | 8/1980 | France . | |

*Primary Examiner*—Eli Lieberman
*Assistant Examiner*—Michael C. Wimer
*Attorney, Agent, or Firm*—Pollock, Vande Sande & Priddy

[57] ABSTRACT

The invention relates to an adaptive spatial microwave filter for multipolarized antennas and the process of its application. According to the invention, the filter principally consists of two conjugated networks of lines $L_1$, $l_1$; $L_2$, $l_2$; . . . of sections of wires loaded with diodes D mounted in series and essentially symmetrically superposed. The lines are passed through by polarizing currents $I_1$, $I_2$ . . . which according to selected distribution enables attenuation at reception of certain secondary lobes of the antenna pattern. The invention applies in particular to the localization and neutralization of jammers.

4 Claims, 2 Drawing Figures

ADAPTIVE SPATIAL MICROWAVE FILTER FOR MULTIPOLARIZED ANTENNAS AND THE PROCESS OF ITS APPLICATION

This invention relates to an adaptive spatial microwave filter for multipolarized antennas and the process of its application.

U.S. Pat. No. 4,344,077 CHEKROUN granted to the Societe d'Etude du Radant, described an adaptive spatial microwave filter for attenuating or cancelling secondary lobes of a microwave antenna pattern emitting a linearly polarized wave, a process consisting of placing in front of the antenna as a filter, a network of wires parallel to the electronic field vector of the microwave, loaded with variable resistances, such as diodes and through which pass currents whose law of distribution in each wire is chosen according to the secondary lobes of the pattern to be attenuated or canceled.

This process is limited, in its applications, to microwave antennas emitting linearly polarized waves.

This invention is an improvement to the previous patent that enables attenuation or cancellation of secondary lobes upon reception of the multipolarized microwave antenna pattern, i.e., linearly, circularly right or left, elliptically polarized, etc.

The invention enables a jammer to be localized, for example by site or bearing.

The process of attenuation or cancellation of secondary lobes, upon reception, of the multipolarized microwave antenna pattern, in accordance with the invention, consists of placing in front of the antenna, in the path of the wave emitted by the latter, a filter consisting of at least two conjugated networks of interrupted conducting lines composed of sections of wires mounted in series, loaded with resistances the values of which vary continuously according to the intensity of the currents that pass through them, which intensity can be changed at will in each conducting line of section mentioned above, said conducting lines being placed between the networks so that said sections belonging to each network cross and intermingle without any electric contact of one line of a network with the corresponding adjacent line of the other network. Advantageously, lines are composed of sections of wire essentially equal and successive, placed along an essentially continuously curved surface and essentially orthogonal from one section to the next, while each network comprises a family of such lines, essentially parallel and placed with an essentially constant distance between lines.

In practice, variable resistances mentioned above consist of diodes, e.g., of the PIN type.

As in the patent mentioned above, each line of both conjugated networks are supplied with electric currents polarizing diodes in the pass direction through a switch which makes it possible to vary the intensities of the continuous currents crossing the lines within a broad range of microampere values up to approximately ten milliamperes.

When all the lines of the conjugated networks are crossed by the same current, the filter thus constituted and supplied, and placed in front of the antenna, provokes an identical total phase shift over the microwave. Moreover, insertion losses of such a filter are essentially inversely proportional to the intensity of the continuous current crossing conducting lines. By selecting intensities of several milliamperes, close to saturation, one provokes an attentuation of transmission that is very weak and uniformly distributed over the entire surface of the filter, thus having no effect on the antenna pattern at emission. The uniform phase shift at transmission introduced over the incident microwave is weak and on the order of a few degrees. The filter can be adapted, as is known, within a frequency band on the order of 15 percent around the antenna's nominal frequency, either by sinking conducting wire lines in a dielectric material layer of given thickness, or by using two identical filters placed one after the other and separated by a certain distance called the adaptation length. In such a configuration, it thus appears that the filter is practically "transparent" to the emission (and to the reception) of the microwave emitted (or received).

On the other hand, when through the switch mentioned above, one supplies each conjugated line of both conjugated networks in the pass direction with spatially modulated electric currents, i.e., generally different from two conjugated lines to another two, one observes a distortion of the antenna pattern in which appear attenuations or cancellations of secondary lobes in given directions other than those of the principal lobe, with these attenuations or cancellations being a function of the modulation of current values, in the various lines.

The modulation effect can be observed directly on the antenna pattern; it can also be predicted and theoretically calculated by applying the computational method explained in U.S. Pat. No. 4,344,077 mentioned above.

What is different from that patent is that this time one does not use rectilinear wires loaded with diodes, but rather the superposition in space of interrupted conducting lines composed of sections of wires loaded with diodes mounted in series, with the superposition of two conjugated lines crossed by a current of the same intensity thus taking the place of each rectilinear wire loaded with diodes in the patent mentioned above. With such a new arrangement, the adaptive microwave filter can be used, however the wave emitted by the antenna may be polarized.

The invention also relates to an adaptive spatial filter for a multipolarized microwave antenna characterized in that it comprises at least two conjugated networks of interrupted conducting lines composed of sections of wires mounted in series and loaded with variable resistances, such as diodes, said lines being supplied with current whose intensity can be varied and modulated from one line to the next by means of an electronic switch, said lines being placed from one network to the other in a way that said sections in each network cross and intermingle with no electric contact of one line of a network with the adjacent line of the other network. Said lines are composed of sections of wires essentially equal and successively placed along an essentially continuously curved surface and essentially orthogonal from one section to the next. Each network comprises a family of such essentially parallel lines placed at an essentially constant distance from one line to the other.

Advantageously, said lines are placed on either side of a carrier surface of dielectric material of a thickness adapted to the antenna frequency. This carrier surface thus assures both adaptation of the filter and electric separation of conjugated lines favorable to a more regular distribution of currents in different sections.

The invention, as well as its various applications will be clarified by the following description made with reference to the attached drawings in which.

Figure 1:
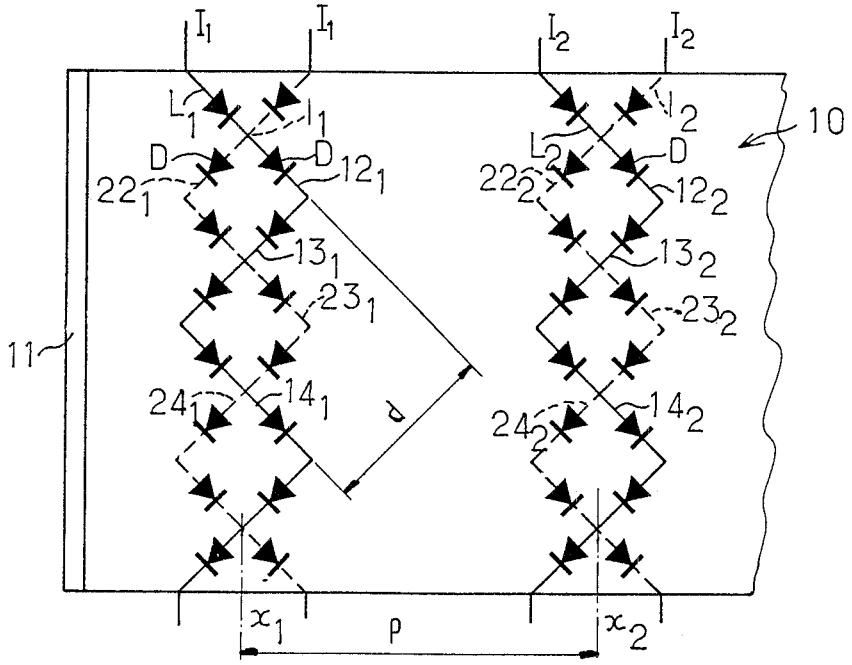
FIG. 1 shows in schematic isolation a panel carrying two networks of conjugated interrupted lines composed of sections of wires loaded with diodes to achieve a filter in accordance to the invention.

According to the method of achievement illustrated in FIG. 1, a filter 10 consists of a sheet carrier of a dielectric material 11 which carries on one side (shown in solid line) interrupted conducting lines $L_1$, $L_2$, etc., each one composed of sections of wires such as marked $\mathbf{12}_1$, $\mathbf{13}_1$, $\mathbf{14}_1$, $\mathbf{12}_2$, $\mathbf{13}_2$, $\mathbf{14}_2$ . . . each carrying two diodes D. In the illustrated example, the surface of dielectric material 11 is essentially plane and the successive sections of wires are placed essentially orthogonally, so that general directions of lines such as $L_1$, $L_2$, etc., are parallel straight lines $x_1$, $x_2$ . . . .

On the other side of the sheet of dielectric material 11, is symmetrically placed a conjugated network of conducting lines (shown in broken line) $l_1$, $l_2$, etc., directed essentially symmetrically, so that each section such as $\mathbf{22}_1$, $\mathbf{23}_1$, $\mathbf{24}_1$ . . . $\mathbf{22}_2$, $\mathbf{23}_2$, $\mathbf{24}_2$ . . . of lines $l_1$, $l_2$ . . . intermingle (with no electric contact) essentially orthogonally to adjacent homologous sections of conjugated line $L_1$, $L_2$ . . . . Obviously, lines $l_1$, $l_2$ . . . have the same general direction $x_1$, $x_2$ . . . as conjugated lines $L_1$, $L_2$ . . . , the middles of orthogonal sections of wire crossing one another at these precise lines $x_1$, $x_2$ . . . .

In such an arrangement, the length of sections marked d sets the distance between two successive diodes D. Distance p between two adjacent lines $L_1$- $L_2$, $l_1$- $l_2$ (or their general direction) gives the pitch of the network patterns corresponding to the pitch of the rectilinear wires of the patent application mentioned above.

When the panel must be "transparent", and more particularly at antenna emission, through each line such as $L_1$, $L_2$ . . . $l_1$, $l_2$ . . . are passed important currents on the order of several milliamperes, all equal and close to currents of saturation of diodes. In such conditions, the filter adapted to the antenna because of the existence of an appropriate thickness of dielectric material 11 introduces only a slight uniform phase shift on the order of a few degrees.

At reception, the various currents which cross the various conjugated lines of both networks are modulated by means of an electronic switch (not shown here) according to the effect of attenuation of such and such secondary lobe to be obtained. Thus, if one wants for example to attenuate such secondary lobe located over 30 degrees from the antenna pointing direction, an intensity current $I_1$ will be passed through conjugated lines $L_1$, $l_1$, an intensity current $I_2$ through lines $L_2$, $l_2$, etc., the value of intensities determined either experimentally or predicted by means of calculation. The fact of using two crossed and conjugated networks of interrupted conducting lines through which similar currents pass, enables attenuation of the secondary lobe in a determined direction, whatever the polarization direction of the wave received may be.

For example, a filter was achieved to work at a 1050 MHZ frequency. In this achievement the sheet of dielectric material 11 was 0.3 millimeters thick. Each section of wire had a length d of 120 millimeters and carried two diodes of PIN type HP379 60 millimeters distant from one another. The diameter of the metal wire constituting the sections was 0.2 millimeters. The pitch of patterns p was 95 millimeters. Overall dimensions of the panel were 5 by 2.5 meters.

With such a panel and the microwave emitted by the antenna polarized, the creation of "holes" was made possible, i.e., attenuation and cancellation of essentially all secondary lobes of the antenna pattern with no essential modification of the principal lobe in directions varying by 60 degrees on either side of the other principal lobe, each attentuation of a secondary lobe corresponding to a determined law of distribution of currents in the various conducting lines of the filter.

Figure 2:
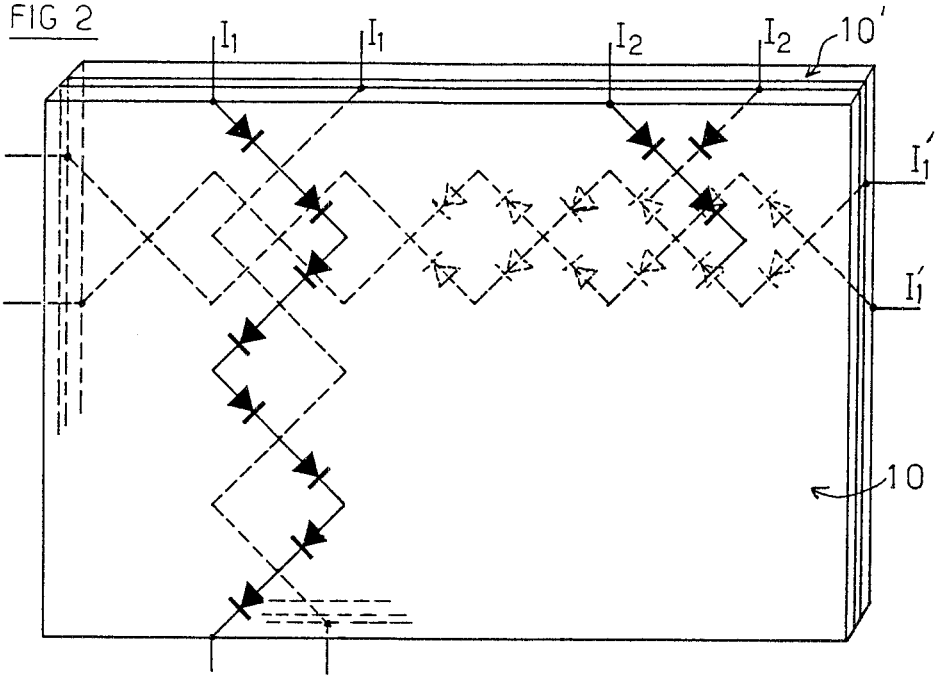
FIG. 2 shows schematically the utilization in superposition of two crossed filters of the type illustrated in FIG. 1 enabling localization of a jammer.

A particular application of the filter described is the utilization of two filters placed one after the other in different directions and preferably essentially orthogonally as schematically illustrated in FIG. 2.

In this case, two identical filters 10, 10' are placed in front of the antenna at a short distance from one another. To make the description easier, let us say that filter 10 placed in front of filter 10' is placed essentially vertically but with an essentially horizontal general direction of the lines.

In these conditions, the research to localize a jammer is done by modulating intensities $I_1$, $I_2$ . . . of filter 10 and $I'_1$, $I'_2$, etc., of filter 10' in order to obtain a maximal attenuation of the noise coming from the jammer.

In these conditions, filter 10 gives the bearing angle of the jammer immediately, whereas filter 10' gives the site angle, these two angles being determined directly and respectively by laws of distribution of currents settled in filter 10 and filter 10' and producing maximal attenuation. It should be noted that such a localization was not possible under the conditions of the above-mentioned patent, even if the wave was linearly polarized, since the two networks previously described could not be crossed.

Although the examples described refer to essentially plane filters, it immediately appears that the filter can be achieved on any essentially continuously curved surface, cylindrical or spherical for example, best adapted to the equipped antenna.

Similarly, as mentioned above, the adaptation of networks can be achieved by duplication at an appropriate adaptation distance of two identical filters.

I claim:

1. A microwave filter positionable in front of a radar antenna for attenuating or cancelling secondary lobes of a microwave beam, the filter comprising:

a plurality of first zig-zag planar networks, each having conductors serially connected to diodes biased in the same direction and lying along respective parallel axes;

a second plurality of zig-zag networks, each having conductors serially connected to diodes biased in the same direction and lying in a parallel spaced plane with respect to that of the first networks, the second zig-zag networks being the mirror image of the first and lying along respective parallel axes; and terminal means connected to respective networks for conducting control currents of adjustable values therethrough which varies the resistance of the diodes accordingly, thereby attenuating or cancelling secondary lobes of the microwave beam without affecting the primary lobes regardless of polarization type.

2. The filter set forth in claim 1 wherein each network associated with an axis is comprised of individual serially connected perpendicular legs arranged in a constant pitch pattern, and further wherein the serially connected diodes in each network are connected with a constant pitch.

3. The filter set forth in claim 1 together with at least third and fourth zig-zag networks, similar to the first and second networks respectively, and positioned in orthogonal spaced relation to the first and second networks.

4. The filter set forth in claim 2 wherein the terminals are supplied with equal current during radar transmission for forward biasing the diodes of the networks, the terminals being supplied with unequal currents which forward bias the diodes and cause preselected attentuation or cancellation of the secondary lobes.

* * * * *